US011421488B2

(12) United States Patent
Breaux et al.

(10) Patent No.: US 11,421,488 B2
(45) Date of Patent: Aug. 23, 2022

(54) MECHANICAL LOCKING SYSTEM TO ELIMINATE MOVEMENT BETWEEN DOWNHOLE COMPONENTS

(71) Applicant: Halliburton Energy Services, Inc., Houston, TX (US)

(72) Inventors: Brian David Breaux, Houston, TX (US); James Howell Cobb, Houston, TX (US); Michael Dewayne Finke, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/140,391

(22) Filed: Jan. 4, 2021

(65) Prior Publication Data

US 2022/0213741 A1 Jul. 7, 2022

(51) Int. Cl.
*E21B 17/16* (2006.01)

(52) U.S. Cl.
CPC ..... *E21B 17/16* (2013.01)

(58) Field of Classification Search
CPC ..... E21B 17/16
See application file for complete search history.

(56) References Cited

U.S. PATENT DOCUMENTS 3,608,933 A * 9/1971 Lee ..... F16B 39/24 285/39
3,857,178 A * 12/1974 Stevens, II ..... A61B 17/322 30/344
3,863,959 A 2/1975 Blaschke
4,379,494 A 4/1983 Sheshtawy
7,624,799 B2 12/2009 Myhre et al.
7,980,874 B2 7/2011 Finke et al.
8,413,325 B2 4/2013 Finke et al.
8,756,807 B2 6/2014 Finke et al.
8,844,127 B2 9/2014 Finke et al.
(Continued)

FOREIGN PATENT DOCUMENTS

AU 1743483 2/1984
CN 2180773 8/1994
WO 98-22690 5/1998

OTHER PUBLICATIONS

International Search Report and Written Opinion for Application No. PCT/US2021/013128, dated Oct. 1, 2021.

*Primary Examiner* — Giovanna Wright
*Assistant Examiner* — Ronald R Runyan
(74) *Attorney, Agent, or Firm* — Benjamin Ford; C. Tumey Law Group PLLC

(57) ABSTRACT

A drilling tool system includes a drilling tool collar having at least one recess and a sleeve disposed around the drilling tool collar, wherein the sleeve comprises at least one slot configured to align with the at least one recess. The drilling tool system further includes an inner key disposed within the at least one recess, an outer key secured within the at least one slot and at least partially disposed within the at least one recess, and at least one fastener configured to drive the inner key in a first lateral direction and the outer key in a second lateral direction to secure the inner key against a first lateral surface and the outer key against a second lateral surface, and wherein securing the inner key and the outer key restrains rotational movement of the sleeve with respect to the tool collar.

18 Claims, 9 Drawing Sheets

(56) References Cited

U.S. PATENT DOCUMENTS

| | | | | |
|---|---|---|---|---|
| 9,217,301 | B1 | 12/2015 | Latham | |
| 9,598,913 | B2 | 3/2017 | Buytaert et al. | |
| 9,650,844 | B2 | 5/2017 | Finke et al. | |
| 9,705,235 | B2 | 7/2017 | Finke et al. | |
| 10,323,486 | B2 | 6/2019 | Cobb et al. | |
| 10,655,447 | B2 | 5/2020 | Tilley et al. | |
| 2016/0369920 | A1* | 12/2016 | Pallini, Jr. ..... | F16L 15/08 |

* cited by examiner

MECHANICAL LOCKING SYSTEM TO ELIMINATE MOVEMENT BETWEEN DOWNHOLE COMPONENTS

BACKGROUND

Wells may be drilled into subterranean formations to recover natural deposits of hydrocarbons and other desirable materials trapped in geological formations in the Earth's crust. A drill bit located on a bottom hole assembly (BHA) at a distal end of a drill string may be rotated during drilling operations to drill into the subterranean formations. To assist in drilling operations, the BHA may include a measurement-while-drilling (MWD) system, a rotatory steerable system, and/or other suitable systems. Some systems (e.g., the MWD system) may be sensitive to downhole conditions. As such, the systems may be disposed within a drilling tool collar of the BHA. Additionally, a protective sleeve may be disposed over a portion of the drilling tool collar to protect the drilling tool collar from the downhole conditions. However, relative movement between the protective sleeve and the drilling tool collar may result in eventual failure via fretting, grinding or fatigue and/or other failure mechanisms. As such, protective sleeves are traditionally heat shrunk or threaded to drilling tool collar to mitigate relative movement. However, replacing these protective sleeves and/or manufacturing threaded sleeves and drilling tool collars may be costly, time consuming, and reduce efficiency of the drilling operations.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein is a drilling tool system for limiting relative movement between a drilling collar and a protective sleeve disposed around the drilling collar via at least one key assembly. In downhole measurement-while-drilling (MWD) applications, relative movement between components of a drilling tool may result in eventual failure via fretting, grinding or fatigue and/or other failure mechanisms. As set forth in detail below, the drilling tool system limits relative movement between a drilling collar and a corresponding sleeve, while still permitting large sustained loads to be transmitted through the sleeve into the drilling collar, to reduce risk of failure or other conditions that negatively affect efficiency of drilling operations.

Figure 1:
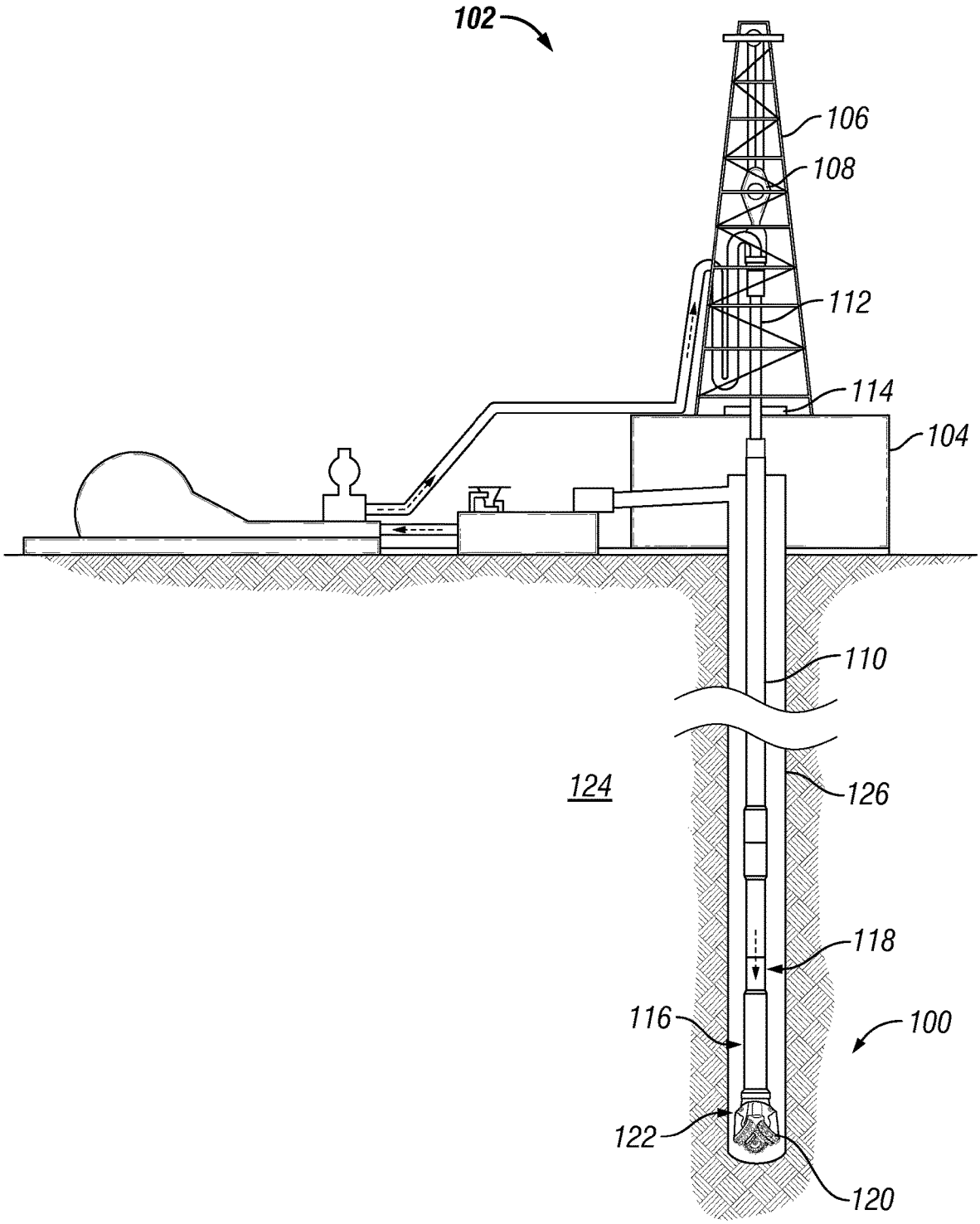
FIG. 1 illustrates a side elevation, partial cross-section view of an operational environment for a drilling tool system in accordance with one or more embodiments of the disclosure.

FIG. 1 illustrates a side elevation, partial cross-section view of an embodiment of an operational environment for a drilling tool system 100 in accordance with one or more embodiments of the disclosure. While FIG. 1 generally depicts a land-based drilling assembly, those skilled in the art will readily recognize that the principles described herein are equally applicable to subsea drilling operations that employ floating or sea-based platforms and rigs, without departing from the scope of the disclosure. As illustrated, the drilling assembly 102 includes a drilling platform 104 that supports a derrick 106 having a traveling block 108 for raising and lowering a drill string 110. The drill string 110 includes, but is not limited to, drill pipe, as generally known to those skilled in the art. A kelly 112 is lowered through a rotary table 114 and can be used to transmit rotary motion from the rotary table 114 to the drill string 110. A bottom hole assembly (BHA) 116 is attached to a distal end 118 of the drill string 110 and may transmit the rotary motion from the drill string 110 to a drill bit 120 attached to a distal end 122 of the BHA 116. Alternatively, the BHA 116 may include a mud motor system to drive rotation of the drill bit 120. As the drill bit 120 rotates, it penetrates various subterranean formations 124 to create a wellbore 126. The BHA 116 may include other systems such as a measurement-while-drilling (MWD) system, rotatory steerable system, or any suitable system for drilling operations.

Figure 2:
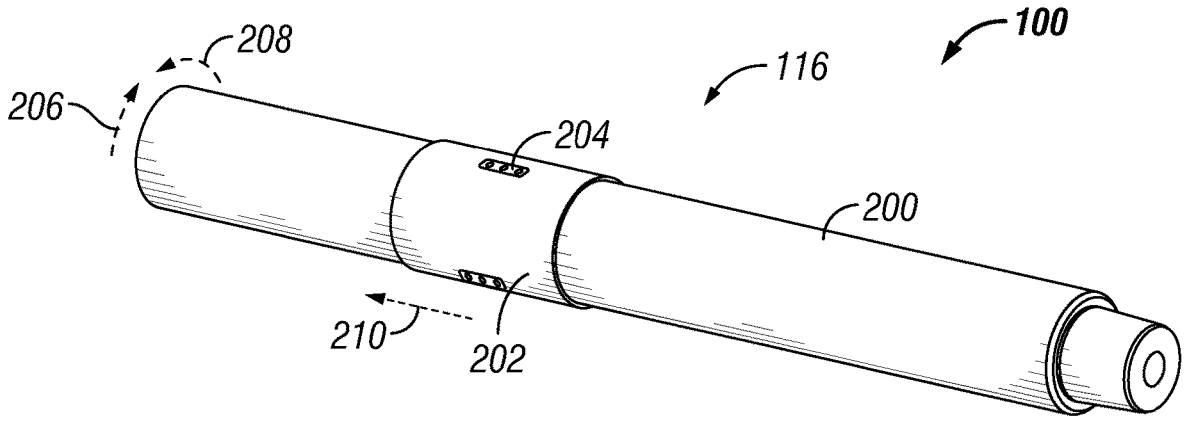
FIG. 2 illustrates a perspective view of an embodiment of a drilling tool collar of a bottom hole assembly in accordance with some embodiments of the present disclosure.

FIG. 2 illustrates a perspective view of an embodiment of a drilling tool collar 200 of the BHA 116 in accordance with some embodiments of the present disclosure. As set forth above, the BHA 116 may include the MWD system (not shown) or another suitable system, which may be disposed within the drilling tool collar 200 of the BHA 116. The drilling tool collar 200 may be configured to house the MWD system to protect the MWD system from damage associated with downhole drilling conditions (e.g., mechanical impacts, abrasion, high temperature). A protective sleeve 202 may be disposed over the drilling tool collar 200 proximate a portion of the drilling tool collar 200 that houses the MWD system to further protect the MWD system, as well as to protect the corresponding portion of the drilling tool collar 200 from damage associated with the downhole drilling conditions. Over time, the sleeve 202 may wear due to exposure to the downhole drilling conditions. Traditionally, sleeves are attached to drilling tool collars via heat shrinking, welding, or other fastening methods. As such, replacing sleeves may be time consuming and prone to incidental damage to drilling tool collars as the sleeves must to be cut-off in order to be replaced. In some cases, the drilling tool collars need to be shipped offsite for removal and replacement of the sleeves. To expedite and improve a replacement process, the illustrated drilling tool system 100 includes a key assembly 204 for attaching and detaching the sleeve 202 to and from the drilling tool collar 200.

During drilling operations, intermittent and/or sustained forces acting on the sleeve 202 may drive the sleeve 202 to move relative to the drilling tool collar 200. For example, as the drilling tool collar 200 rotates in a counterclockwise direction 206, these forces may drive the sleeve 202 predominantly in a clockwise direction 208, as well as in an axially upward direction 210 with respect to the drilling tool collar 200. The key assembly 204 may be configured to keep the sleeve 202 positioned over the corresponding portion of the drilling tool collar 200. That is, the key assembly 204 of the drilling tool system 100 may be configured to anchor the sleeve 202 to the drilling tool collar 200 to at least restrain movement of the sleeve 202 in the clockwise 208 and axially upward direction 210 with respect to the drilling tool collar 200. In another example, the drill string may rotate in a clockwise direction 208 such that the intermittent and/or sustained forces acting on the sleeve 202 may drive the sleeve 202 in a counterclockwise direction 206 and the axially upward direction with respect to the drilling tool collar 200. In this example, the key assembly 204 may be configured to restrain movement of the sleeve 202 in the counterclockwise 206 and axially upward 210 directions with respect to the drilling tool collar 200.

In addition to the forces driving the sleeve 202 predominantly in the axial upward 210 and clockwise 208 or counterclockwise 206 directions with respect to the drilling tool collar 200, overall conditions during drill operations may generally cause jitter (e.g., irregular movement), vibrational movement (e.g., periodic or random back-and-forth movement), and/or other types of movement between the sleeve 202 and the drilling tool collar 200. Such movement may lead to eventual failure of the sleeve 202, the drilling tool collar 200, and/or other components via fretting, grinding, fatigue, and/or other failure methods. To restrain and/or prevent such relative movement of the sleeve 202 with respect to the drilling tool collar 200, the key assembly 204 is configured to secure the sleeve 202 to the drilling tool collar 200. In particular, the key assembly 204 may be configured to secure the sleeve 202 to the drilling tool collar 200 to restrain and/or prevent rotational movement, axial movement, radial movement, or some combination thereof, of the sleeve 202 with respect to the drilling tool collar 200; thereby, reducing and/or preventing jitter or vibrational movement between the drilling tool collar 200 and the sleeve 202. In some embodiments, the key assembly 204 may be configured to restrain and/or prevent all relative movement (e.g., rotational movement and translational movement) of the sleeve 202 with respect to the drilling tool collar 200.

Figure 3:
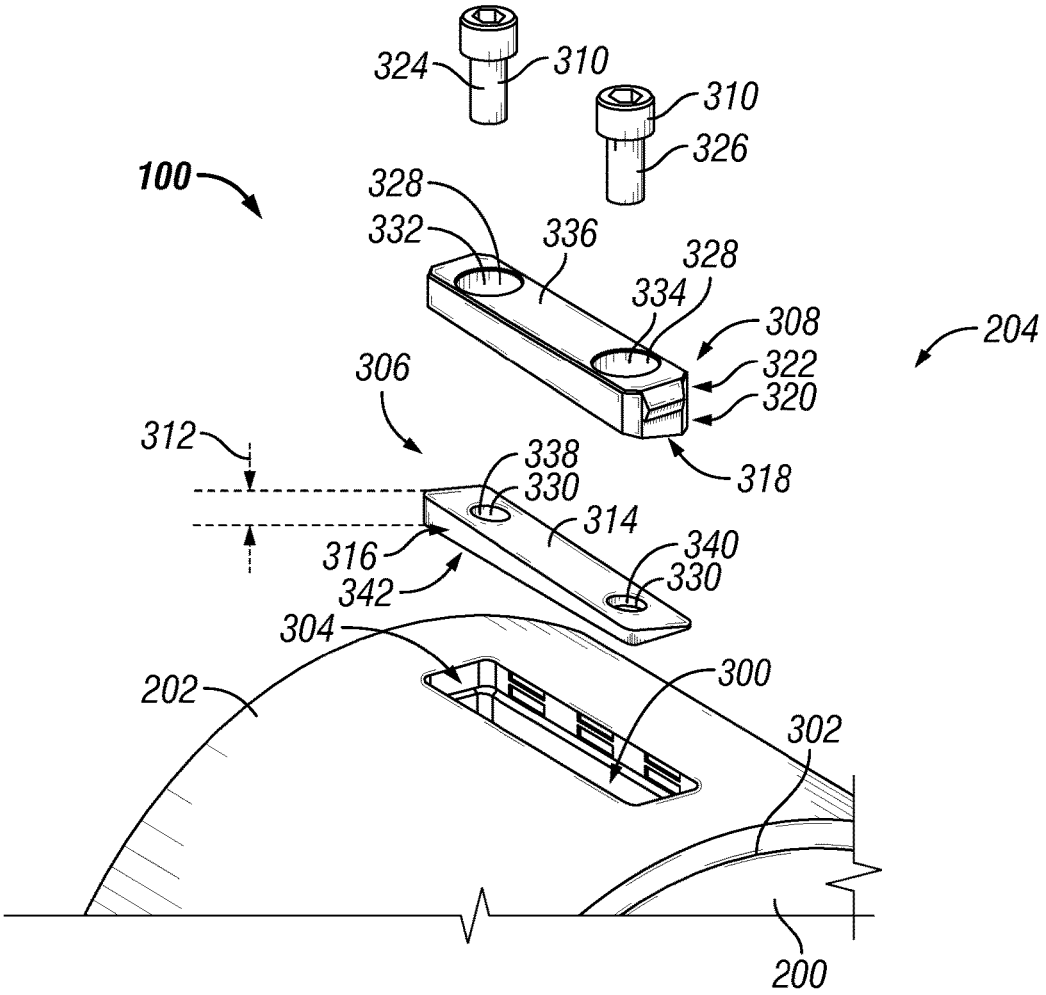
FIG. 3 illustrates an exploded view of an embodiment of a drilling tool system in accordance with some embodiments of the present disclosure.

FIG. 3 illustrates an exploded view of an embodiment of the drilling tool system 100 in accordance with some embodiments of the present disclosure. As illustrated, the drilling tool system 100 includes the drilling tool collar 200 having at least one recess 300 in an outer surface 302 of the drilling tool collar 200. The recess 300 may be formed in a radial outer surface of the drilling tool collar 200 and have a generally rectangular cross-section along a depth of the recess 300. However, the recess 300 may include any suitably shaped cross-section (e.g., circular, triangular, quadrilateral, non-uniform, etc.). Additionally, the drilling tool system includes the sleeve 202 disposed around the drilling tool collar 200. As set forth above, the sleeve 202 is configured to shield at least a portion of the drilling tool collar 200. The sleeve 202 includes at least one slot 304 extending through the sleeve 202. In particular, the slot 304 is configured to extend from an outer surface of the sleeve 202, through a body portion of the sleeve 202, and to an inner surface of the sleeve 202. The slot 304 may include a cross-section shaped similar to the cross-section of the recess 300. For example, the slot 304 may have a substantially rectangular shaped cross-section in an embodiment where the recess 300 has a rectangular shaped cross-section. In another example, the slot 304 may include a substantially triangular shaped cross-section in an embodiment where the recess 300 has a triangular shaped cross-section. Moreover, the slot 304 may include a cross-section sized (e.g., width, length, area) similar to the cross-section of the recess 300. The slot 304 is configured to align with the recess 300 such that the key assembly 204 of the drilling tool system may be inserted into and secured within both the recess 300 and the slot 304 to restrain and/or prevent relative movement of the sleeve 202 with respect to the drilling tool collar 200.

The key assembly 204 may include an inner key 306, an outer key 308, and at least one fastener 310. The inner key 306 may comprise a cross-section shaped similar to the cross-section of the recess 300 such that the inner key 306 may be inserted into the recess 300 of the drilling tool collar 200 during installation. For example, in the illustrated embodiment, the inner key 306 has generally rectangular shaped cross-section corresponding to the rectangular shaped cross-section of the recess 300. However, the inner key 306 may have non-uniform cross-section along a height 312 of the inner key 306. The inner key 306 may include an angled top surface 314 such that a top portion 316 of the inner key 306 forms a wedge shape. Moreover, the outer key 308 may have an angled bottom surface 318 forming a corresponding wedge shape configured to interface with the angled top surface 314 of the inner key 306 during operation. The outer key 308 may be inserted into and fit within both the recess 300 of the drilling tool collar 200 and the slot 304 of the sleeve 202 during operation. That is, a bottom portion 320 of the outer key 308 may be inserted into the recess 300, and a top portion 322 of the outer key 308 may extend out from the recess 300 and fit within the slot 304. In the illustrated embodiment, the outer key 308 has a generally rectangular shaped cross-section corresponding to the rectangular shaped cross-sections of the recess 300 and the slot 304.

Further, the key assembly 204 includes at least one fastener 310 configured to secure the inner key 306 and the outer key 308 within the recess 300 and the slot 304. In the illustrated embodiment, the key assembly 204 includes two fasteners 310 (e.g., a first fastener 324 and a second fastener 326) configured to thread and/or insert through respective outer key bores 328 or inner key bores 330 of the outer key 308 and the inner key 306 and fasten to a portion of the recess 300. In particular, the outer key 308 includes a first outer key bore 332 and a second outer key bore 334 configured to receive the first fastener 324 and the second fastener 326, respectively. The first outer key bore 332 and the second outer key bore 334 may extend through a top surface 336 and a bottom surface (e.g., the angled bottom surface 318) of the outer key 308. Similarly, the inner key 306 includes a first inner key bore 338 and a second inner key bore 340 configured to receive the first fastener 324 and the second fastener 326, respectively. The first inner key bore 338 and a second inner key bore 340 may extend through the top surface (e.g., the angled top surface 314) and a bottom surface 342 of the inner key 306.

Figure 4:
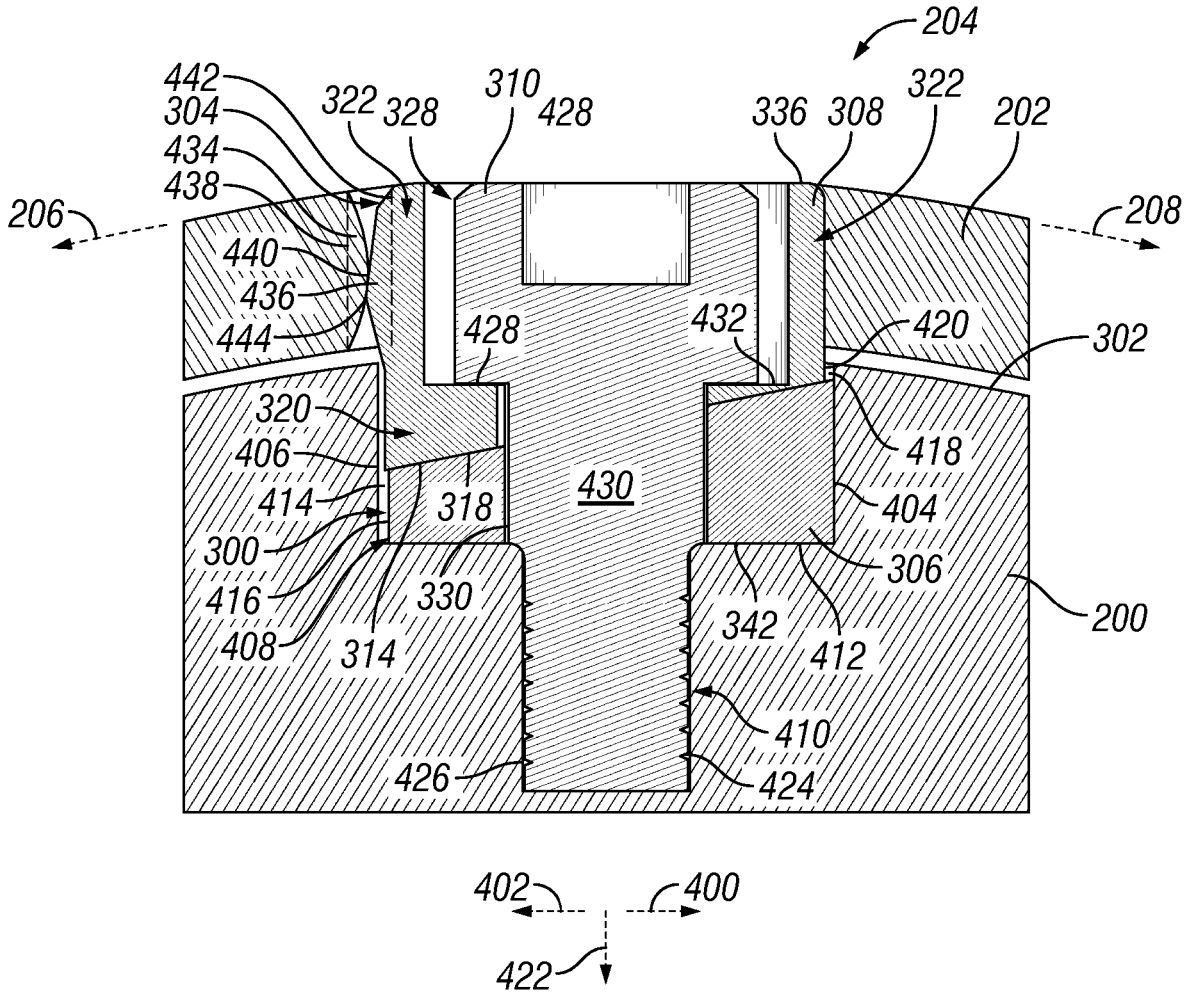
FIG. 4 illustrates a cross-sectional view of the at least one key assembly secured within the recess of the tool collar and the slot of the sleeve in accordance with some embodiments of the present disclosure.

FIG. 4 illustrates a cross-sectional view of an embodiment of the at least one key assembly 204 secured within the recess 300 of the drilling tool collar 200 and the slot 304 of the sleeve 202, in accordance with some embodiments of the present disclosure. As set forth above, the sleeve 202 may be disposed around the drilling tool collar 200 such that the slot 304 of the sleeve 202 and the recess 300 of the drilling tool collar 200 are substantially aligned. The key assembly 204 may be inserted into the recess 300 and the slot 304. In particular, the inner key 306 and the bottom portion 320 of the outer key 308 may be inserted into the recess 300 and the top portion 322 of the outer key 308 may be press-fit into the slot 304. Press-fitting the outer key 308 into the slot 304 may secure the key assembly 204 to the sleeve 202. Further, the at least one fastener 310 may be inserted through the inner key bore 330 of the inner key 306 and an outer key bore 328 of the outer key 308 and threaded into the recess 300. Tightening the fastener 310 into the recess 300 may drive the inner key 306 in a first lateral direction 400 and the outer key 308 in a second lateral direction 402 to secure the inner key 306 against a first lateral sidewall 404 and the outer key 308 against a second lateral sidewall 406 within the recess 300. Securing the inner key 306 to the first lateral sidewall 404 and the outer key 308 to the second lateral sidewall 406 opposite the first lateral sidewall 404 may secure the key assembly 204 to the drilling tool collar 200. Moreover, securing the key assembly 204 to both the sleeve 202 and the drilling tool collar 200 may restrain and/or prevent relative movement (e.g., rotational movement, axial movement) of the sleeve 202 with respect to the drilling tool collar 200.

In the illustrated embodiment, the recess 300 is formed in the outer surface 302 of the drilling tool collar 200. The recess 300 may include a first portion 408 and a second portion 410. As illustrated, the first portion 408 of the recess 300 may extend into the drilling tool collar 200 from the outer surface 302 of the drilling tool collar 200. The first portion 408 of the recess 300 may include a substantially rectangular shaped cross-section. However, the first portion 408 of the recess 300 may include any suitably shaped cross-section. In the illustrated embodiment, the first portion 408 of the recess 300 includes the first lateral sidewall 404, the second lateral sidewall 406, and a bottom surface 412. As the cross-section of the first portion 408 may be uniform along a depth of the first portion 408 of the recess 300, the first lateral sidewall 404 and the second lateral sidewall 406 may be parallel to each other. Further, the first lateral sidewall 404 and the second lateral sidewall 406 may be positioned substantially normal to rotational forces acting on the sleeve 202. Thus, as the key assembly 204 is secured to the sleeve 202, securing the inner key 306 and the outer key 308 (e.g., key assembly 204) against the first 404 and second 406 lateral sidewalls, respectively, may restrain and/or prevent rotational movement (e.g., clockwise 208 and counter-clockwise 206 rotation) of the sleeve 202 with respect to the drilling tool collar 200. In some embodiments, the inner key 306 and the outer key 308 may be configured to secure against sidewalls of the recess 300 positioned substantially normal to axial forces acting on the sleeve 202; thereby, restraining and/or preventing axial movement of the sleeve 202 with respect to the drilling tool collar 200.

Further, the first portion 408 of the recess 300 may be sized with respect to the inner key 306 to form a first gap 414 between a side surface 416 of the inner key 306 and the first 404 and/or second 406 lateral sidewall of the first portion 408 of the recess 300. The first gap 414 may be sufficiently sized to permit lateral movement of the inner key 306 to within the first portion 408 of the recess 300. In some embodiments, the first gap 414 may be sized to permit axial movement of the inner key 306 within the gap. Moreover, the first portion 408 may also be sized with respect to the bottom portion 320 of the outer key 308 such that a second gap 418 is formed between a side surface 420 of the bottom portion 320 of the outer key 308 and the first 404 and/or second 406 lateral sidewall of the first portion 408 of the recess 300. As the bottom portion 320 of the outer key 308 is similarly sized to the inner key 306, the second gap 418 may span a distance similar to the first gap 414. Prior to tightening the fastener 310 during installation, the first gap 414 and the second gap 418 may be contiguous. After installation, the first gap 414 may be positioned between the inner key 306 and the second lateral sidewall 406, and the second gap 418 may be positioned between the bottom portion 320 of the outer key 308 and the first lateral sidewall 404.

The second portion 410 of the recess 300 may extend radially inward 422 from the first portion 408 of the recess 300. Specifically, the second portion 410 may extend radially inward 422 from the bottom surface 412 of the first portion 408 of the recess 300. As set forth above, the second portion 410 of the recess 300 is configured to receive the at least one fastener 310 of the key assembly 204. The second portion 410 may include at least one circular, threaded bore configured to receive the at least one fastener 310 of the key assembly 204. Threads 424 of the second portion 410 may correspond with threads 426 of the fastener 310 such that the fastener 310 may thread into the second portion 410 of the recess 300. Tightening the fastener 310 into the second recess 300 may press a bottom surface 428 of a head 430 of the fastener 310 into a lip 432 in the outer key bore 328 of the outer key 308, which may force the outer key 308 into the inner key 306 and the inner key 306 into the bottom surface 412 of the recess 300; thereby, compressing the outer key 308 against the inner key 306. As set forth above, the inner key 306 includes the angled top surface 314, and the outer key 308 includes the corresponding angled bottom surface 318 configured to interface within the angled top surface 314. As the angled top 314 and bottom 318 surfaces are non-parallel and non-perpendicular to the compressive force exerted in the radially inward direction 422 on the inner key 306 and the outer key 308 via the fastener 310, the compressive force will result in both lateral and radial force components acting on the inner key 306 and the outer key 308. The radial force components acting on the inner key 306 and the outer key 308 may force the inner key 306 and the outer key 308 radially inward 422 against the bottom surface 412 of the recess 300; thereby, securing the key assembly 204 radially with respect to the recess 300.

Further, the lateral force component acting on the inner key 306 may cause the inner key 306 and the outer key 308 to slide laterally (e.g., in the first lateral direction 400 or the second lateral direction 402) within the recess 300. Increasing the respective angles of the top 314 and bottom 318 angled surfaces may increase the magnitude of the lateral force components acting on the inner key 306 and the outer key 308. The top 314 and bottom 318 angled surfaces may include angularly offset from the lateral directions 400, 402 by an angle between 1-20 degrees. The minimum angle for the top 314 and bottom 318 angled surfaces may result in respective lateral forces components that are slightly greater than frictional forces opposing lateral movement of the inner key 306 and the outer key 308 within the recess 300. In some embodiment, a lubricant may be disposed between the top 314 and bottom 318 angled surfaces and/or between the bottom surface 342 of the inner key 306 and the bottom surface 412 of the recess 300 to reduce the frictional forces inhibiting lateral movement of the inner key 306 and the outer key 308 within the recess 300.

In the illustrated embodiment, the lateral force component acting on the inner key 306 may be greater than the frictional forces such that a resultant force acting on the inner key 306 may cause the inner key 306 to slide laterally in the first lateral direction 400 along the first portion 408 of the recess 300 and into the first lateral sidewall 404 of the recess 300; thereby, restraining and/or preventing clockwise 208 rotation of the sleeve 202 with respect to the drilling tool collar 200. Moreover, the resultant force from the lateral force component acting on the outer key 308 may drive the outer key 308 to slide laterally in the opposite direction (e.g., the second lateral direction 402) toward the second lateral sidewall 406 of the recess 300; thereby, restraining and/or preventing counterclockwise 206 rotation of the sleeve 202 with respect to the drilling tool collar 200. In the illustrated embodiment, the key assembly 204 may be configured to restrain and/or prevent rotational movement of the sleeve 202 with respect to the drilling tool collar 200 under higher loads in the clockwise direction 206 than in the counterclockwise direction 208 based on the orientation of the inner key 306 and the outer key 308 within the recess 300. In another embodiment, reversing the orientation of the key assembly 204 such that the inner key 306 is secured against the second sidewall and the outer key 308 is secured against the first sidewall may cause the key assembly 204 to restrain and/or prevent rotational movement of the sleeve 202 with respect to the drilling tool collar 200 under higher loads in the counterclockwise direction 206 than in the clockwise direction 208.

Moreover, as set forth above, the outer key 308 may be press-fit within the slot 304 during installation of the key assembly 204 to secure the key assembly 204 to the sleeve 202. The slot 304 may include a slot locking feature 434, and the key assembly 204 may include a corresponding key locking feature 436. The key locking feature 436 may be press-fit against the slot locking feature 434 during insertion of the key assembly 204 through the slot 304 to secure the key assembly 204 to the sleeve 202. The slot locking feature 434 may be formed via variable geometry (e.g., non-uniform geometry) of the cross-section of the slot 304 along a depth of the slot 304. In some embodiments, the slot 304 generally includes a uniform cross-section, similar to the cross-section of the recess 300, with the slot locking feature 434 extending inward from the uniform cross-section. In the illustrated embodiment, the slot locking feature 434 extends inward from a first sidewall 438 of the slot 304. However, the slot locking feature 434 may extend inward from a plurality of sidewalls of the slot 304 (e.g., the first sidewall 438 and a second sidewall of the slot 304). Further, each sidewall may include a plurality of slot locking features 434 corresponding to respective key locking features 436 of the key assembly 204. In some embodiments, the slot locking feature 434 may include a separate component fastened to the sidewall of the slot 304 via welding, brazing, fasteners, etc. The slot locking feature 434 may be shaped to gradually decrease a dimension (e.g., width, length, diameter) of the slot 304 in the radially inward direction 422 along the depth to a peak 440 of the slot locking feature 434. From the peak, the slot locking feature 434 may be shaped to gradually increase a dimension (e.g., width, length, diameter) of the slot 304 in the radially inward direction 422.

The key locking feature 436 may be formed in a side surface 442 of the top portion 322 of the outer key 308 (i.e., the portion of the outer key 308 disposed in the slot 304 during operation). The key locking feature 436 may be shaped to protrude outward from the side surface 442 of the top portion 322 of the outer key 308. In the illustrated embodiment, the key locking feature 436 is configured to gradually increase a dimension (e.g., width, length, diameter) of the outer key 308 along the radially inward direction 422 from the top surface 336 of the outer key 308 to a protrusion tip 444. From the protrusion tip 444, the slot locking feature 434 may be shaped to gradually decrease a dimension (e.g., width, length, diameter) of the outer key 308 along the radially inward direction toward the bottom portion 320 of the outer key 308.

To secure the key assembly 204 to the slot 304, the key assembly 204 is inserted through the slot 304 and into the recess 300 of the drilling tool collar 200. Corresponding heights of the inner key 306 and the outer key 308 may be configured such that the protrusion tip 422 of the key locking feature 436 is disposed at the peak 440 of the slot locking feature 434 or radially inward 422 from the peak 440. Positioning the protrusion tip 444 radially inward 422 from the peak 440 of the slot locking feature 434 may at least partially hold the key assembly 204 within the recess 300 and the slot 304 in the absence of the fastener 310 of the key assembly 204 being threaded into the recess 300. In some embodiments, positioning the protrusion tip 444 radially inward 422 from the peak 440 may help restrain and/or prevent radial movement of the sleeve 202 with respect to the drilling tool collar 200. Specifically, to secure the key assembly 204 to the slot 304, the key assembly 204 may be sized such that the dimension (e.g., width, length, diameter) of the outer key 308 at the protrusion tip 444 is greater than or equal to the corresponding dimension of the slot locking feature 434 at the peak 440. Such sizing and shaping of the key locking feature 436 and the slot locking feature 434 may compress or preload the outer key 308 as the protrusion tip 444 is positioned at the peak 440. In the illustrated embodiment, the outer key 308 is inserted into the slot 304 such that the protrusion tip 444 is positioned radially inward 422 with respect to the peak 440. As such, the slot locking feature 434 and the key locking feature 436 may be sized such that the outer key 308 is in compression with the protrusion tip 444 being positioned radially inward 422 with respect to the peak 440; thereby securing the key assembly 204 to the slot 304.

Figure 5A:
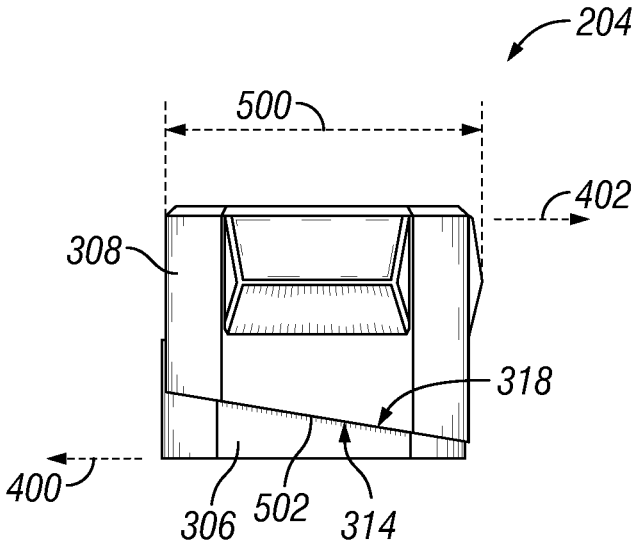
FIG. 5A illustrates a front view of the inner key and the outer key of the key assembly, in accordance with some embodiments of the present disclosure.
Figure 5B:
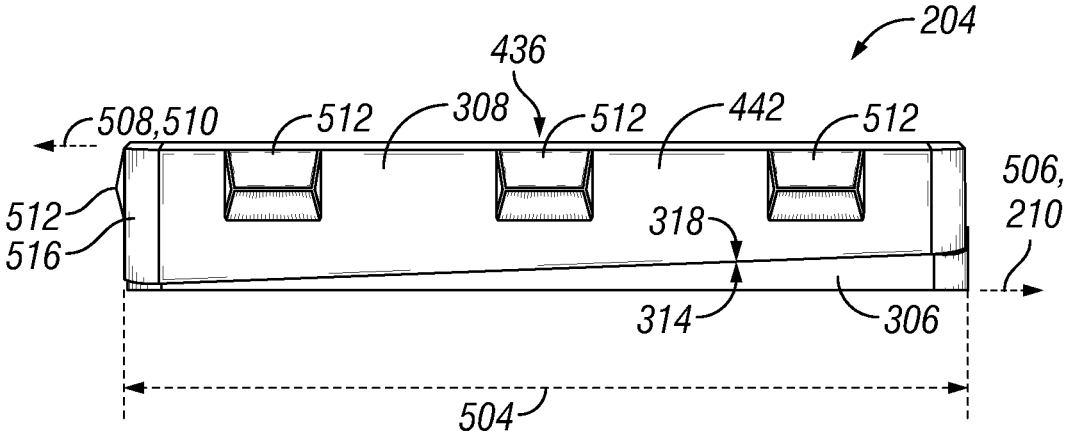
FIG. 5B illustrates a side view of the inner key and the outer key of the key assembly, in accordance with some embodiments of the present disclosure.

FIGS. 5A and 5B illustrate front and side views of an embodiment of the inner key 306 and the outer key 308 of the key assembly 204, in accordance with some embodiments of the present disclosure. Referring to FIG. 5A, the key assembly 204 includes the inner key 306 having the angled top surface 314 and the outer key 308 having the angled bottom surface 318 configured to interface with the angled top surface 314. In the illustrated embodiment, the angled top surface 314 and the angled bottom surface 318 may be angled along a width 500 of the key assembly 204. As such, tightening the fastener 310 (e.g., shown in FIG. 4) may drive the inner key 306 in the first lateral direction 400 and the outer key 308 in the second lateral direction 402; thereby, expanding the effective width 500 of the key assembly 204 to secure the key assembly 204 against the first 404 and second 406 lateral sidewalls of the recess 300 (e.g., shown in FIG. 4). Based at least in part on the orientation of the recess 300 in the drilling tool collar 200, securing the key assembly 204 against the lateral sidewalls of the recess 300 may restrain and/or prevent rotational movement of the sleeve 202 with respect to the drilling tool collar 200 (e.g., shown in FIG. 4).

In some embodiments, the first lateral direction 400 is tangent to a direction of rotational forces exerted on the sleeve 202 with respect to the drilling tool collar 200 during drilling operations (e.g., shown in FIG. 4). Further, an interface 502 between the angled bottom surface 318 and the angled top surface 314 may be sloped downward in the second lateral direction 402. Based on the slope of the interface 502, the key assembly 204 may be configured to restrain and/or prevent axial movement of the sleeve 202 with respect to the drilling tool collar 200 under higher loads on the sleeve 202 in the first lateral direction 400 than in the second lateral direction 402.

Referring to FIG. 5B, the key assembly 204 includes the inner key 306 having the angled top surface 314 and the outer key 308 having the angled bottom surface 318 configured to interface with the angled top surface 314. In the illustrated embodiment, the angled top surface 314 and the angled bottom surface 318 may be angled along a length 504 of the key assembly 204. As such, tightening the fastener 310 (e.g., shown in FIG. 4) may drive the inner key 306 in a first longitudinal direction 506 and the outer key 308 in a second longitudinal direction 508 along; thereby, expanding an effective length 504 of the key assembly 204 to secure the key assembly 204 against longitudinal sidewalls of the recess 300. In some embodiments, the first longitudinal direction 506 may be an axially upward direction 210 with respect to the drilling tool collar 200 (e.g., shown in FIG. 2). Based at least in part on the orientation of the recess 300 in the drilling tool collar 200, securing the key assembly 204 against the longitudinal sidewalls of the recess 300 may restrain and/or prevent axial movement of the sleeve 202 with respect to the drilling tool collar 200. In some embodiments, the angled top surface 314 and the angled bottom surface 318 may be angled along both the width 500 and the length 504 of the respective outer key 308 and inner key 306 to restrain and/or prevent radial and axial movement of the sleeve 202 with respect to the drilling tool collar 200.

In some embodiments, the first 506 and second 508 longitudinal directions may correspond to respective axially upward 210 and axially downward 510 directions with respect to the drilling tool collar 200. The interface 502 between the angled bottom surface 318 and the angled top surface 314 may be sloped downward along a second longitudinal direction 508 (e.g., axially downward direction) with respect to the drilling tool collar 200. Based on the slope of the interface 502, the key assembly 204 may be configured to restrain and/or prevent axial movement of the sleeve 202 with respect to the drilling tool collar 200 under higher loads on the sleeve 202 in the axially upward direction 210 than in the axially downward direction 510.

Moreover, the key assembly 204 includes a key locking feature 436 comprising a plurality of protrusions 512 extending outward from the outer key 308. Each protrusion 512 may be configured to interface with a corresponding feature of the slot locking feature 434 (e.g., shown in FIG. 4). In the illustrated embodiment, the protrusions 512 comprise triangular prism shapes extending outward from the top portion 322 of the outer key 308. However, the protrusions 512 may comprise any suitable shape. Further, the protrusions 512 may be configured to extend from a plurality of outer surfaces 514 of the outer key 308. For example, the protrusion may be configured to extend outward from the side surface 442 of the top portion 322 of the outer key 308 and from an end surface 516 of the top portion 322 of the outer key 308.

Figure 6:
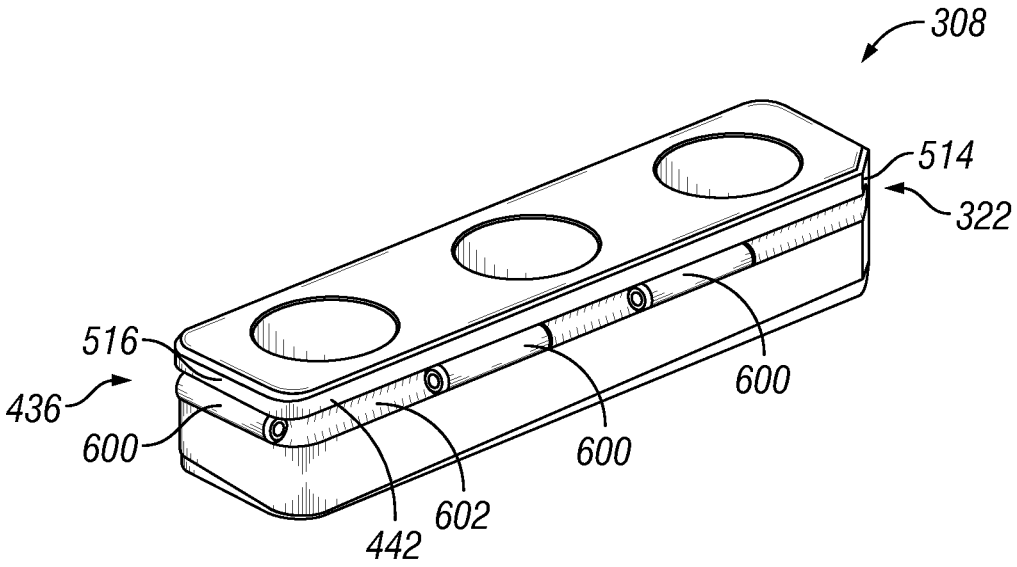
FIG. 6 illustrates a perspective view of an embodiment of a key locking feature, in accordance with some embodiments of the present disclosure.

FIG. 6 illustrates a perspective view of an embodiment of a key locking feature 436, in accordance with some embodiments of the present disclosure. As set forth above, the key locking feature 436 may include a protrusion extending outward from the outer key 308 (e.g., shown in FIG. 5B). Alternatively, as illustrated, the key locking feature 436 may include a pin 600 disposed in a milled slot 602 formed in the outer key 308. The milled slot 602 may be formed in the outer surface 514 of the top portion 322 of the outer key 308. In the illustrated embodiment, the milled slot is 602 formed in the side surface 442 of the top portion 322 of the outer key 308 and in the end surface 516 of the top portion 322 of the outer key 308. The milled slot 602 may be configured to receive at least a portion of the pin 600. During installation of the key assembly 204 into the recess 300 and the slot 304 (e.g., shown in FIG. 7), the pin 600 may be configured to elastically deform due to compressive forces from the slot locking feature 434 and/or sidewall of the slot 304 to secure the key assembly 204 to the sleeve 202 (e.g., shown in FIG. 7).

Figure 7:
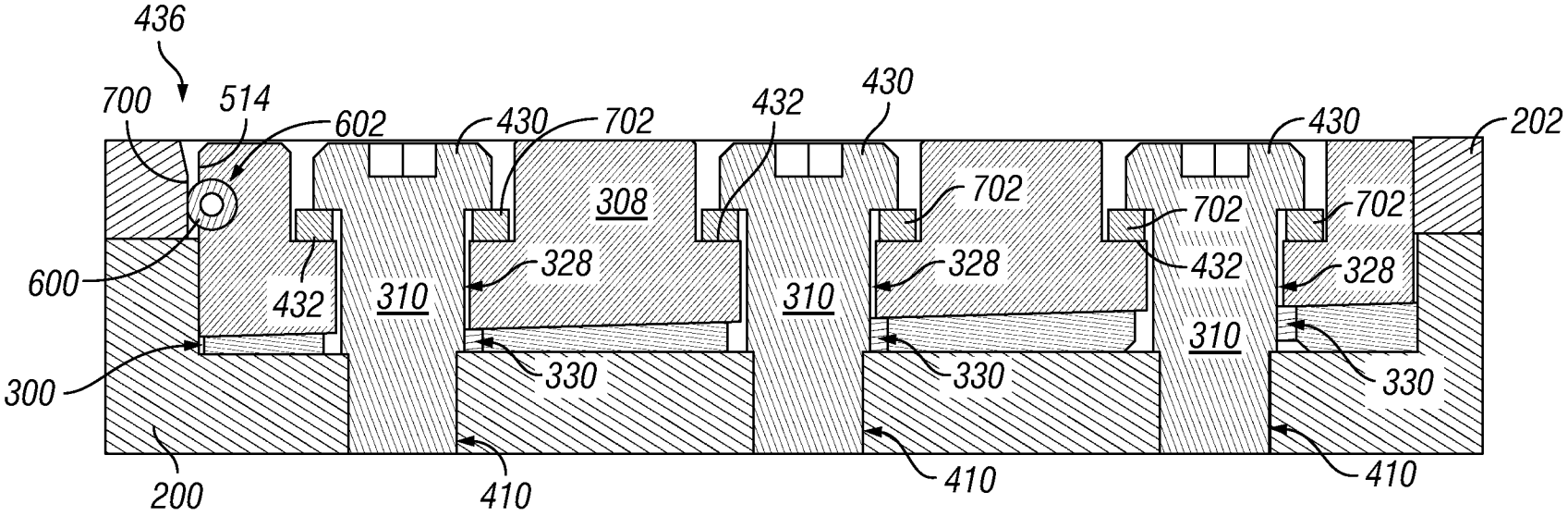
FIG. 7 illustrates a cross-sectional view of another embodiment of the key locking feature configured to secure the outer key within the slot, in accordance with some embodiments of the present disclosure.

FIG. 7 illustrates a cross-sectional view of another embodiment of the key locking feature 436 configured to secure the outer key 308 within the slot 304, in accordance with some embodiments of the present disclosure. As set forth above, the key locking feature 436 may include the pin 600 disposed in the milled slot 602 formed in the outer surface 514 of the outer key 308. In the illustrated embodiment, the pin 600 is configured to elastically deform due to compressive forces from a second sidewall 700 of the slot 304 to secure the key assembly 204 to the sleeve 202. That is, the key locking feature 436 may secure the key assembly 204 to the sleeve 202 without the slot locking feature 434. However, in some embodiments, the slot 304 may include the slot locking feature configured to receive at least a portion of the pin 600.

Moreover, in the illustrated embodiment, the key assembly 204 includes a plurality of fasteners 310 configured for insertion through respective outer 328 and inner 330 key bores and threading into respective second portions 410 of the recess 300 to secure the key assembly 204 within the recess 300 of the drilling tool collar 200. The key assembly 204 may further include a plurality of washers 702 corresponding to each fastener 310 of the plurality of fasteners. Each washer 702 may be disposed between the head 430 of the corresponding fastener 310 the corresponding lip 432 in the respective inner key bores 330. The plurality of washers 702 may include wedge-locking washers, spline washers, flat face washers, or any suitable type of washer.

Figure 8:
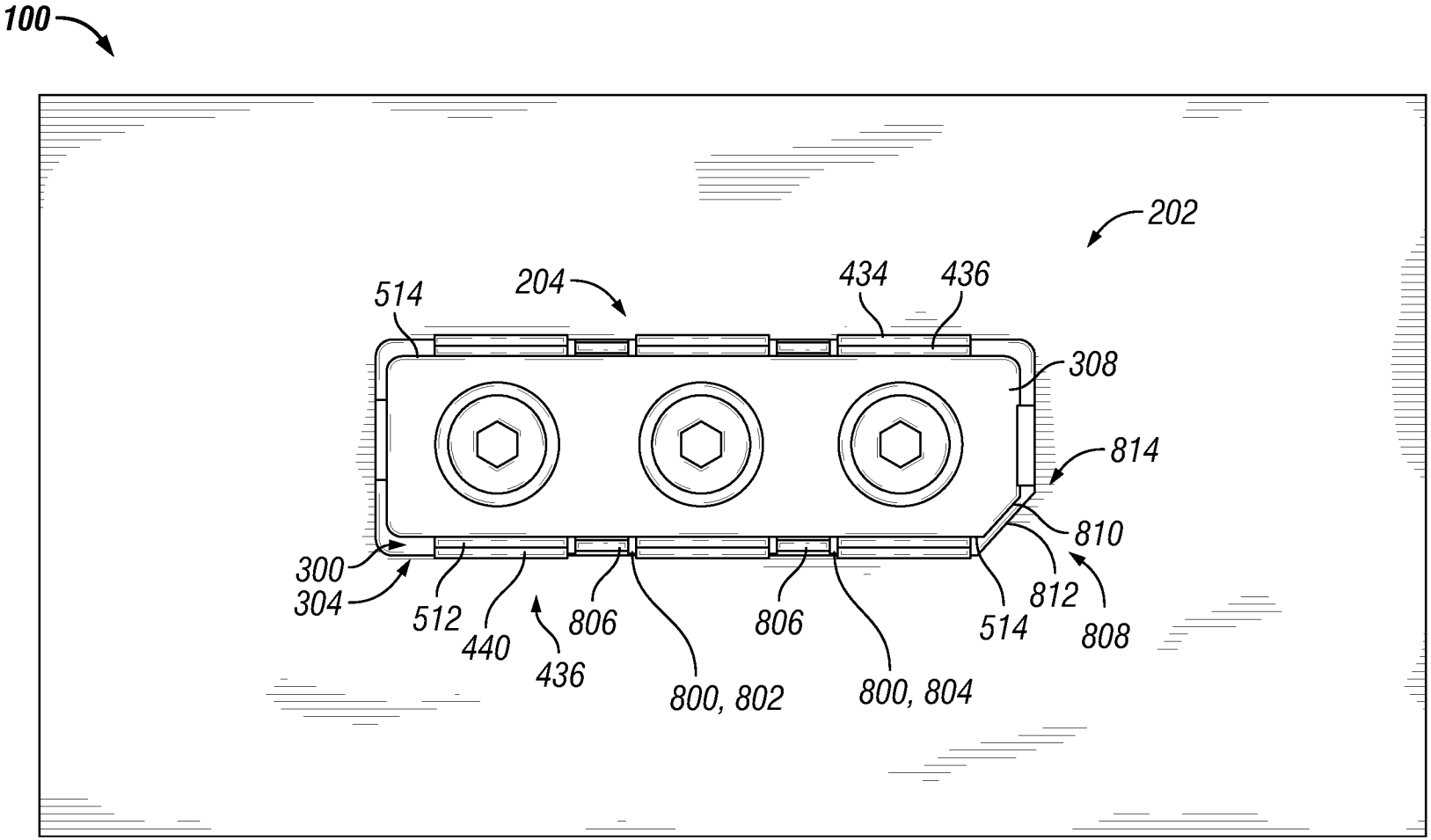
FIG. 8 illustrates a top view of an embodiment of the key assembly disposed in the slot and the recess, in accordance with some embodiments of the present disclosure.

FIG. 8 illustrates a top view of an embodiment of the key assembly 204 disposed in the slot 304 and the recess 300, in accordance with some embodiments of the present disclosure. As illustrated, the key locking feature 436 may include a plurality of gaps 800 (e.g., first gap 802 and second gap 804) disposed between adjacent protrusions 512 of the key locking feature 436 and/or between adjacent peaks 440 slot locking features 434. To further secure the key assembly 204 to the sleeve 202, the key assembly 204 may include shims 806 disposed in the plurality of gaps 800. That is, the each of the shims 806 may be disposed in corresponding gaps 800 between the adjacent protrusions 512 of the key locking feature 436, adjacent peaks 440 of the slot locking feature 434, the outer surfaces 514 of the outer key 308, and the sidewall of the slot 304 to further secure the outer key 308 within the slot 304.

Moreover, the drilling tool system 100 may include an orientation system 808 configured to limit insertion of the key assembly 204 into the slot 304 and recess 300 to a single orientation. In particular, the orientation system 808 may include a key orientation feature 810 formed in the outer key 308 of the key assembly 204 and a corresponding slot orientation feature 812 formed in the slot 304 of the sleeve 202. The key orientation feature 810 may include a chamfer formed at a corner 814 of the outer key 308. The chamfer may have a straight or curved edge and may extend along a depth of the outer key 308. The slot orientation feature 812 may include a corresponding chamfer extending into a portion of the slot 304 such that the key assembly 204 may only be inserted into the slot 304 with the key orientation feature 810 positioned proximate the slot orientation feature 812.

Figure 9:
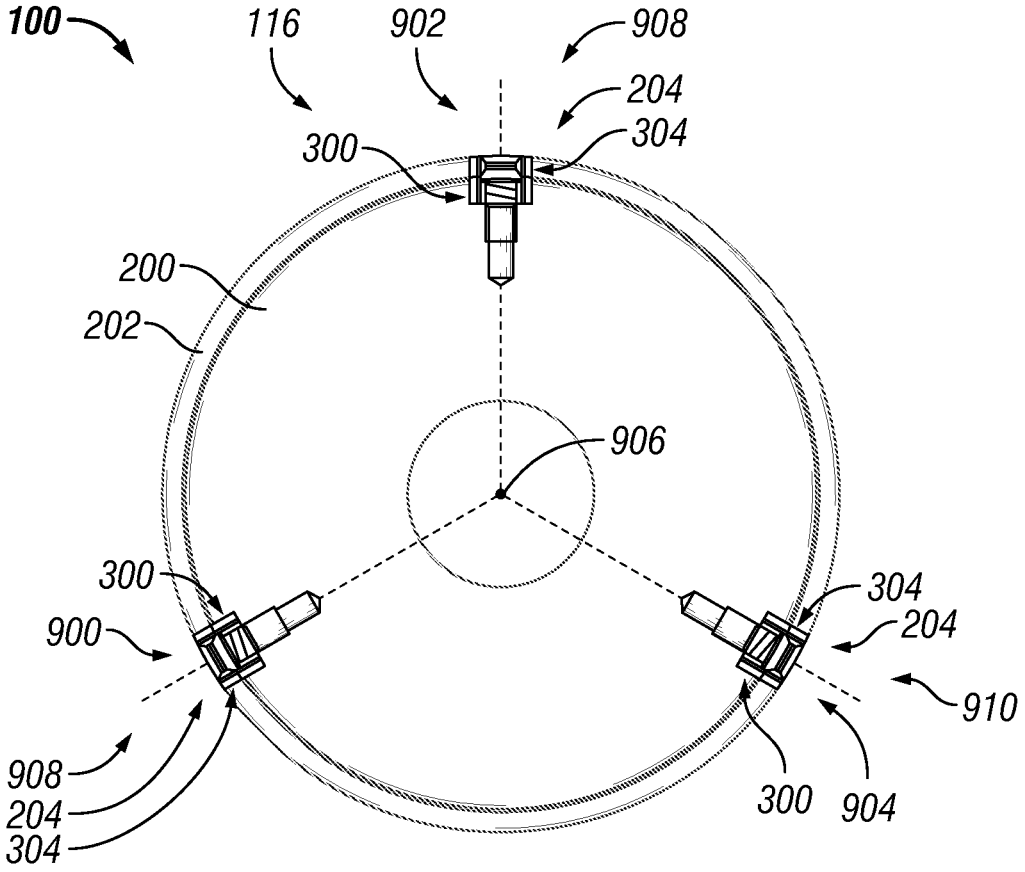
FIG. 9 illustrates a cross-sectional view of an embodiment of the drilling tool system, in accordance with some embodiments of the present disclosure.

FIG. 9 illustrates a cross-sectional view of an embodiment of the drilling tool system 100, in accordance with some embodiments of the present disclosure. The drilling tool system 100 may include a plurality of key assemblies 204. The plurality of key assemblies 204 may limit radial movement of the sleeve 202 with respect to the drilling tool collar 200. The drilling tool collar 200 may include a plurality of recesses 300 each configured receive a corresponding key assembly 204 of the plurality of key assemblies. Further, the sleeve 202 may include a plurality of slots 304 each configured to align with a corresponding recess 300 and to receive a corresponding key assembly 204. In the illustrated embodiment, the slots 304 and recesses 300 may be spaced evenly around the circumference of the respective sleeve 202 and drilling tool collar 200 such that the plurality of key assemblies are spaced evenly around the circumference of the sleeve 202 and drilling tool collar 200 of the BHA 116. For example, the drilling tool system 100 may include a set of three key assemblies (e.g., a first key assembly 900, a second key assembly 902, and a third key assembly 904) spaced one hundred and twenty degrees apart around the circumference of the BHA 116. In some embodiments, the key assemblies may be spaced unevenly around the circumference of the BHA 116. For example, the first and the second key assemblies may be ninety degrees apart, and the second a third key assemblies may be spaced one hundred and thirty-five degrees apart. Moreover, the drilling tool system may include any number of key assemblies (e.g., 1, 2, 3, 4, 5, etc.) to secure the sleeve 202 to the drilling tool collar 200.

In some embodiments, the drilling tool system 100 includes the plurality of key assemblies 204 with at least two key assemblies axially offset from each other along an axis 906 of the sleeve 202 and/or drilling tool collar 200. For example, the drilling tool system 100 may include a first set of key assemblies 908 (e.g., the first key assembly 900 and the second key assembly 902) axially offset from a second set of key assemblies 910 (e.g., the third key assembly 904). That is, the first set of key assemblies 908 may be positioned downhole or up-hole from the second set of key assemblies 910. In some embodiments, each of the plurality of key assemblies 204 may be axially offset from each other along the axis of the sleeve 202 and/or drilling tool collar 200. For example, plurality of key assemblies 204 may include the second key assembly 902 disposed downhole the first key assembly 900, and the third key assembly 904 may be disposed downhole the second key assembly 902.

Figure 10:
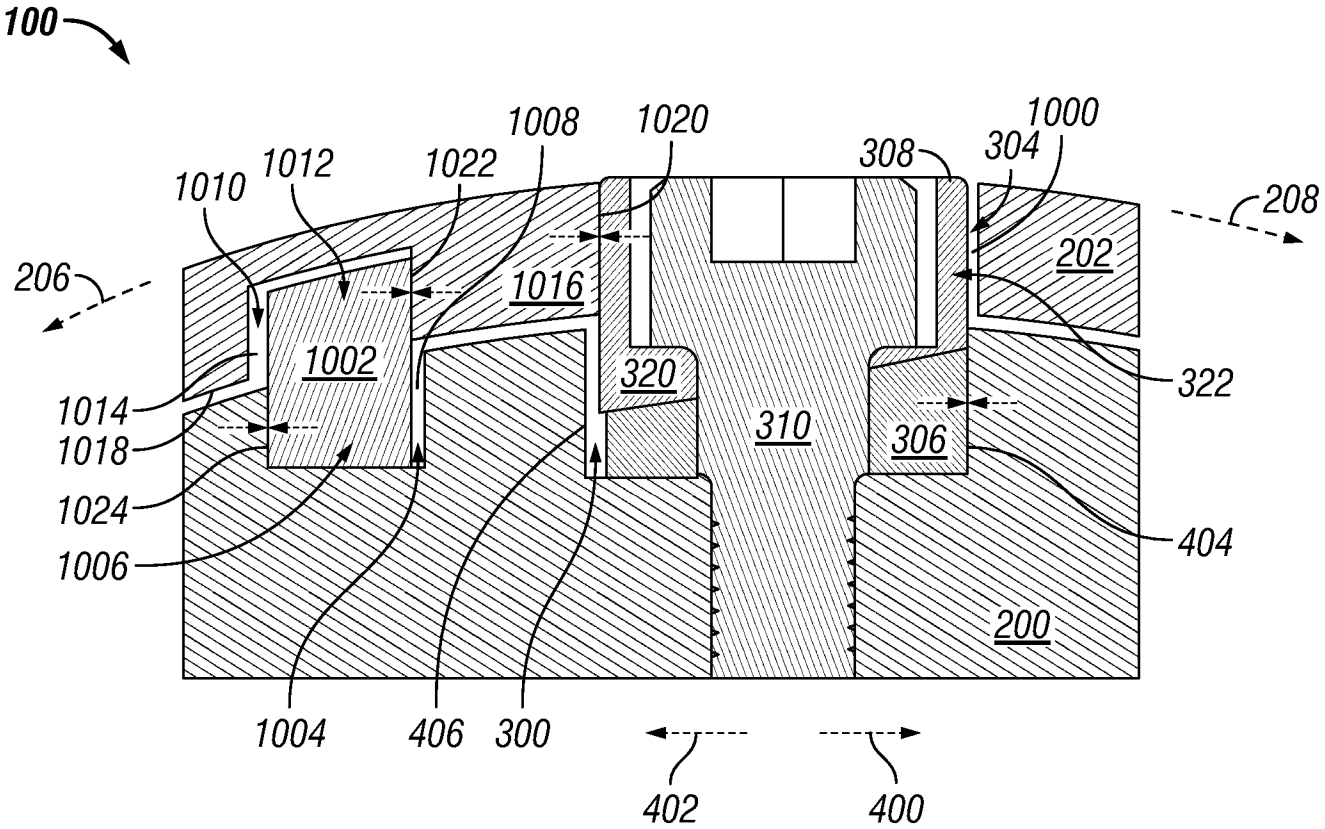
FIG. 10 illustrates a cross-sectional view of another embodiment of the drilling tool system, in accordance with some embodiments of the present disclosure.

FIG. 10 illustrates a cross-sectional view of another embodiment of the drilling tool system 100, in accordance with some embodiments of the present disclosure. As illustrated, the drilling tool collar 200 includes the recess 300 configured to receive the inner key 306 and a bottom portion of the outer key 308. Further, the sleeve 202 includes the slot 304 configured to receive the top portion 322 of the outer key 308. In the illustrated embodiment, the top portion 322 of the outer key 308 is not press fit within the slot 304. That is, the slot 304 may be sized with respect to the top portion 322 of the outer key 308 such that a slot gap 1000 is formed between the slot 304 and the top portion 322 of the outer key 308 after insertion of the key assembly 204 into the recess 300 and the slot 304.

Moreover, the drilling tool system 100 includes a secondary key feature 1002. The secondary key feature 1002 may include a structure configured to elastically deform under forces exhibited on the secondary key feature 1002 during installation. As set forth below, the deformation of the secondary key feature 1002 may aid in securing the sleeve 202 to the drilling tool collar 200. In some embodiments, the secondary key feature 1002 may include geometry configured to facilitate such deformation. For example, the secondary key feature 1002 may include ferrule or crimping loop sleeve 202. Further, the secondary key feature 1002 may include a material configured to facilitate such deformation. For example, the secondary key feature 1002 may include an aluminum material. However, any suitable material (e.g., copper or brass) may be used for the secondary key feature 1002.

The drilling tool collar 200 may include a secondary recess 1004 configured to receive a bottom portion 1006 of the secondary key feature 1002. The secondary recess 1004 may be sized with respect to the secondary key feature 1002 such that a lateral recess gap 1008 is formed between the secondary key feature 1002 and the secondary recess 1004. As such, the secondary key feature 1002 may move laterally (i.e., in the first lateral direction 400 or the second lateral direction 402) within the secondary recess 1004. The secondary key feature 1002 may not be secured within the secondary recess 1004 via a fastener. However, in some embodiments, the secondary key feature 1002 may be loosely and/or temporarily secured within the secondary recess 1004 via a second fastener (e.g., rod, bolt, adhesive, or other suitable fastener) at least prior to installation of the fastener 310 into the recess 300. Moreover, the secondary recess 1004 may be circumferentially offset from the recess 300. For example, in the illustrated embodiment, the secondary recess 1004 is disposed counterclockwise 206 to the recess 300. However, in some embodiments, the secondary recess 1004 may be disposed clockwise 208 to the recess 300.

Further, the sleeve 202 may include a secondary slot 1010 configured to receive a top portion 1012 of the secondary key feature 1002. The secondary slot 1010 may be sized with respect to the secondary key feature 1002 such that a lateral slot gap 1014 is formed between the secondary key feature 1002 and the secondary slot 1010. As such, the secondary key feature 1002 may move laterally within the secondary slot 1010. Moreover, the secondary slot 1010 may be at least partially aligned with the secondary recess 1004. The secondary slot 1010 may only extend partially through a body 1016 of the sleeve 202. As illustrated, the secondary slot 1010 is configured to extend from the radially inner surface 1018 of the sleeve 202 and partially into the body 1016 of the sleeve 202. As such, the top portion 1012 of the secondary key feature 1002 may be shield from downhole drilling conditions via the sleeve 202.

As set forth above, the fastener 310 is configured to compress the outer key 308 against the inner key 306 to drive the inner key 306 in the first lateral direction 400 and the outer key 308 in the second lateral direction 402 opposite the first lateral direction 400; thereby, securing the inner key 306 against the first lateral sidewall 404 and driving the top portion 322 of the outer key 308 into a slot sidewall 1020. The bottom portion 320 of the outer key 308 may not be secured against the second lateral sidewall 406 of the recess 300. Driving the top portion 322 of the outer key 308 into the slot sidewall 1020 may drive the sleeve 202 in the counterclockwise direction 206 and drive a secondary slot sidewall 1022 of the secondary slot 1010 into the secondary key feature 1002. As such, the secondary key feature 1002 may slide laterally (e.g., in the second lateral direction 402) within the secondary slot 1010 and engage a secondary lateral sidewall 1024 of the secondary slot 1010. The secondary lateral sidewall 1024 may engage an opposite side of the secondary key feature 1002 than the secondary slot sidewall 1022. The force driving the sleeve 202 into the secondary key feature 1002 may compress the secondary key feature 1002 between the sleeve 202 and the secondary lateral sidewall 1024, which may cause deformation (e.g., elastic deformation) of the secondary key feature 1002. Such deformation may preload the key assembly 204 and the secondary key feature 1002 against the drilling tool collar 200 and the sleeve 202 to secure the sleeve 202 to the drilling tool collar 200. In particular, via the preloading, the key assembly 204 may be secured against the first lateral sidewall 404 of the drilling tool collar 200 and the slot sidewall 1020 of the sleeve 202 to restrain and/or prevent rotational movement of sleeve 202 with respect to the drilling tool collar 200 in the clockwise direction 208. Further, via the preloading, the secondary key feature 1002 may be secured against the secondary lateral sidewall 1024 of the drilling tool collar 200 and the secondary slot sidewall 1022 of the sleeve 202 to restrain and/or prevent rotational movement of sleeve 202 with respect to the drilling tool collar 200 in the counterclockwise direction 206.

In some embodiments, the secondary key feature 1002 may be configured to not deform under forces exhibited on the secondary key feature 1002 during installation. That is, the secondary key feature 1002 may be a rigid structure. As such, the secondary key feature 1002 may include a steel material. In some embodiments, the secondary key feature 1002 may include a nickel alloy.

Accordingly, the present disclosure may provide a drilling tool system for securing a sleeve to a drilling tool collar via a key assembly. The systems set forth above may include any of the various features disclosed herein, including one or more of the following statements.

Statement 1. A drilling tool system may comprise a drilling tool collar having an outer surface and at least one recess formed in the outer surface; a sleeve disposed around the drilling tool collar, wherein the sleeve comprises at least one slot configured to align with the at least one recess; an inner key disposed within the at least one recess, wherein the inner key comprises an angled top surface; an outer key secured within the at least one slot and at least partially disposed within the at least one recess, and wherein the outer key comprises an angled bottom surface configured to interface with the angled top surface; and at least one fastener configured to drive the inner key in a first lateral direction and the outer key in a second lateral direction to secure the inner key against a first lateral surface and the outer key against a second lateral surface within the at least one recess of the drilling tool collar, and wherein securing the inner key against the first lateral surface and the outer key against the second lateral surface restrains rotational movement of the sleeve with respect to the tool collar.

Statement 2. The system of statement 1, further comprising a key assembly configured to secure the sleeve to the drilling tool collar, wherein the key assembly comprises the inner key, the outer key, and the at least one fastener, and wherein the key assembly is configured to restrain rotational and axial movement of the sleeve with respect to the drilling tool collar.

Statement 3. The system of statement 1, wherein a slope of an interface between the angled bottom surface of the outer key and the angled top surface of the inner key is angularly offset from a lateral direction by an angle between 1-20 degrees.

Statement 4. The system of statement 1, wherein the interface between the angled bottom surface and the angled top surface is sloped downward along a first axial direction with respect to the tool collar, wherein the first axial direction is a downhole direction.

Statement 5. The system of statement 1, wherein the interface between the angled bottom surface and the angled top surface is sloped downward in the second lateral direction, and wherein the second lateral direction is tangent to a rotational direction of the sleeve and the tool collar during drilling operations.

Statement 6. The system of statement 1, wherein the outer key comprises a key locking feature to secure the outer key to the at least one slot in the sleeve.

Statement 7. The system of statement 6, wherein the key locking feature comprises a protrusion extending outward from the outer key, the protrusion comprising a triangular prism shape.

Statement 8. The system of statement 6, wherein the key locking feature comprises a pin disposed in a milled slot formed in a side portion of the outer key.

Statement 9. The system of statement 6, further comprising at least one shim disposed in a gap between adjacent key locking features, the outer key, and the at least one slot to further secure the outer key to the slot.

Statement 10. The system of statement 6, wherein at least a portion of the at least one slot comprises variable geometry to form a slot locking feature, and wherein the slot locking feature is configured to interface with the key locking feature to secure the outer key to the at least one slot in the sleeve.

Statement 11. The system of statement 1, wherein the inner key comprises at least one inner key bore extending through the respective top and bottom surfaces of the inner key, and wherein the outer key comprises at least one outer key bore extending through the respective top and bottom surfaces of the outer key.

Statement 12. The system of statement 11, wherein the at least one fastener is configured to insert into the outer key bore and the inner key bore disposed in a first portion of the recess and thread into a second portion of the recess to compress the outer key against the inner key, and wherein compressing the outer key again the inner key drives the inner key in the first lateral direction and the outer key in the second lateral direction.

Statement 13. A drilling tool system may comprise a drilling tool collar comprising at least one recess and at least one secondary recess formed in an outer surface of the drilling tool collar, wherein the secondary recess is offset from the recess in a first rotational direction; a sleeve disposed around the drilling tool collar, wherein the sleeve comprises at least one slot configured to at least partially align with the recess and at least one secondary slot configured to at least partially align with the secondary recess; at least one secondary key feature secured within the secondary recess and the secondary slot to restrain rotational movement of the sleeve with respect to the tool collar in the first rotational direction; and at least one key assembly secured within the recess and the slot and configured to restrain rotational movement of the sleeve with respect to the drilling tool collar in a second rotational direction.

Statement 14. The system of statement 13, wherein the key assembly comprises: an inner key disposed within the recess, wherein the inner key comprises an angled top surface; an outer key secured within the slot and at least partially disposed within the recess, and wherein the outer key comprises an angled bottom surface configured to interface with the angled top surface; and at least one fastener configured to drive the inner key in a first lateral direction and the outer key in a second lateral direction to secure the inner key against a first lateral sidewall of the recess and force the outer key against the sleeve to drive the sleeve in the first rotational direction, and wherein the sleeve is configured to drive the secondary key feature into a secondary lateral sidewall of the secondary slot to secure the sleeve to the drilling tool collar.

Statement 15. The system of statement 13, wherein the first rotational direction is a counterclockwise direction, and wherein the second rotational direction is a clockwise direction.

Statement 16. The system of statement 13, wherein the secondary key feature is configured to elastically deform to preload the secondary key feature and the key assembly against the respective secondary lateral sidewall of the secondary slot and first lateral sidewall of the slot.

Statement 17. The system of statement 13, further comprising an orientation feature configured to limit insertion of the outer key and the inner key into the slot and the recess to a single orientation.

Statement 18. A drilling tool system may comprise a drilling tool collar having an outer surface and at least one recess formed in the outer surface; a sleeve disposed around the drilling tool collar, wherein the sleeve comprises at least one slot configured to align with the at least one recess, and wherein at least a portion of the at least one slot comprises variable geometry to form a slot locking feature; and a plurality of key assemblies configured to limit rotational and/or axial movement of the sleeve with respect to the drilling tool collar, wherein the key assembly may comprise: an inner key disposed within the at least one recess, wherein the inner key comprises an angled top surface, and wherein the inner key comprises at least one inner key bore; an outer key disposed at least partially within the at least one recess and the at least one slot, wherein a top portion of the outer key includes a key locking feature configured to interface with the slot locking feature to secure the key assembly to the sleeve, wherein the outer key comprises an angled bottom surface configured to interface with the angled top surface, and wherein the outer key comprises at least one outer key bore; and at least one fastener disposed through the outer key bore and the inner key bore and configured to thread into the at least one recess to compress the outer key against the inner key to drive the inner key in a first lateral direction and the outer key in a second lateral direction to secure the key assembly to the drilling tool collar.

Statement 19. The system of statement 18, wherein the plurality of key assemblies are spaced evenly around a circumference of the tool collar.

Statement 20. The system of statement 18, wherein at least two key assemblies axially of the plurality of key assemblies are axially offset from each other with respect to an axis of the tool.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A drilling tool system, comprising:

a drilling tool collar having an outer surface and at least one recess formed in the outer surface;

a sleeve disposed around the drilling tool collar, wherein the sleeve comprises at least one slot configured to align with the at least one recess;

an inner key disposed within the at least one recess, wherein the inner key comprises an angled top surface;

an outer key secured within the at least one slot and at least partially disposed within the at least one recess, wherein the outer key comprises a key locking feature to secure the outer key to the at least one slot in the sleeve, and wherein the outer key comprises an angled bottom surface configured to interface with the angled top surface of the inner key; and at least one fastener configured to drive the inner key in a first lateral direction and the outer key in a second lateral direction to secure the inner key against a first lateral surface and the outer key against a second lateral surface within the at least one recess of the drilling tool collar, and wherein securing the inner key against the first lateral surface and the outer key against the second lateral surface restrains rotational movement of the sleeve with respect to the tool collar.

2. The system of claim 1, further comprising a key assembly configured to secure the sleeve to the drilling tool collar, wherein the key assembly comprises the inner key, the outer key, and the at least one fastener, and wherein the key assembly is configured to restrain rotational and axial movement of the sleeve with respect to the drilling tool collar.

3. The system of claim 1, wherein a slope of an interface between the angled bottom surface of the outer key and the angled top surface of the inner key is angularly offset from a lateral direction by an angle between 1-20 degrees.

4. The system of claim 1, wherein the interface between the angled bottom surface and the angled top surface is sloped downward along a first axial direction with respect to the tool collar, wherein the first axial direction is a downhole direction.

5. The system of claim 1, wherein the interface between the angled bottom surface and the angled top surface is sloped downward in the second lateral direction, and wherein the second lateral direction is tangent to a rotational direction of the sleeve and the tool collar during drilling operations.

6. The system of claim 1, wherein the key locking feature comprises a protrusion extending outward from the outer key, the protrusion comprising a triangular prism shape.

7. The system of claim 1, wherein the key locking feature comprises a pin disposed in a milled slot formed in a side portion of the outer key.

8. The system of claim 1, further comprising at least one shim disposed in a gap between adjacent key locking features, the outer key, and the at least one slot to further secure the outer key to the slot.

9. The system of claim 1, wherein at least a portion of the at least one slot comprises variable geometry to form a slot locking feature, and wherein the slot locking feature is configured to interface with the key locking feature to secure the outer key to the at least one slot in the sleeve.

10. The system of claim 1, wherein the inner key comprises at least one inner key bore extending through the respective top and bottom surfaces of the inner key, and wherein the outer key comprises at least one outer key bore extending through the respective top and bottom surfaces of the outer key.

11. The system of claim 10, wherein the at least one fastener is configured to insert into the outer key bore and the inner key bore disposed in a first portion of the recess and thread into a second portion of the recess to compress the outer key against the inner key, and wherein compressing the outer key against the inner key drives the inner key in the first lateral direction and the outer key in the second lateral direction.

12. A drilling tool system, comprising:

a drilling tool collar comprising at least one recess and at least one secondary recess formed in an outer surface of the drilling tool collar, wherein the secondary recess is offset from the recess in a first rotational direction;

a sleeve disposed around the drilling tool collar, wherein the sleeve comprises at least one slot configured to at least partially align with the recess and at least one secondary slot configured to at least partially align with the secondary recess;

at least one secondary key feature secured within the secondary recess and the secondary slot to restrain rotational movement of the sleeve with respect to the tool collar in the first rotational direction;

at least one key assembly secured within the recess and the slot and configured to drive the sleeve in the first rotational direction and restrain rotational movement of the sleeve with respect to the drilling tool collar in a second rotational direction; and wherein the secondary key feature is configured to elastically deform, to preload the secondary key feature and the key assembly against the respective secondary lateral sidewall of the secondary slot and first lateral sidewall of the slot, in response to the at least one key assembly driving the sleeve in the first rotational direction.

13. The system of claim 12, wherein the key assembly comprises:

an inner key disposed within the recess, wherein the inner key comprises an angled top surface;

an outer key secured within the slot and at least partially disposed within the recess, and wherein the outer key comprises an angled bottom surface configured to interface with the angled top surface; and at least one fastener configured to drive the inner key in a first lateral direction and the outer key in a second lateral direction to secure the inner key against a first lateral sidewall of the recess and force the outer key against the sleeve to drive the sleeve in the first rotational direction, and wherein the sleeve is configured to drive the secondary key feature into a secondary lateral sidewall of the secondary slot to secure the sleeve to the drilling tool collar.

14. The system of claim 12, wherein the first rotational direction is a counterclockwise direction, and wherein the second rotational direction is a clockwise direction.

15. The system of claim 12, further comprising an orientation feature configured to limit insertion of the outer key and the inner key into the slot and the recess to a single orientation.

16. A drilling tool system, comprising:

a drilling tool collar having an outer surface and at least one recess formed in the outer surface;

a sleeve disposed around the drilling tool collar, wherein the sleeve comprises at least one slot configured to align with the at least one recess, and wherein at least a portion of the at least one slot comprises variable geometry to form a slot locking feature; and a plurality of key assemblies configured to limit rotational and/or axial movement of the sleeve with respect to the drilling tool collar, wherein the key assembly comprises:

an inner key disposed within the at least one recess, wherein the inner key comprises an angled top surface, and wherein the inner key comprises at least one inner key bore;

an outer key disposed at least partially within the at least one recess and the at least one slot, wherein a top portion of the outer key includes a key locking feature configured to interface with the slot locking feature to secure the key assembly to the sleeve, wherein the outer key comprises an angled bottom surface configured to interface with the angled top surface, and wherein the outer key comprises at least one outer key bore; and at least one fastener disposed through the outer key bore and the inner key bore and configured to thread into the at least one recess to compress the outer key against the inner key to drive the inner key in a first lateral direction and the outer key in a second lateral direction to secure the key assembly to the drilling tool collar.

17. The system of claim 16, wherein the plurality of key assemblies are spaced evenly around a circumference of the tool collar.

18. The system of claim 16, wherein at least two key assemblies are axially offset from each other with respect to an axis of the tool.

* * * * *